United States Patent [19]

Schemel

[11] 4,257,993

[45] Mar. 24, 1981

[54] METHOD OF PRODUCING FIBRE-REINFORCED CONCRETE AND SHAPED PARTS PRODUCED BY THIS METHOD

[76] Inventor: H. Schemel, Sommerwies, 7622 Schiltach, Fed. Rep. of Germany

[21] Appl. No.: 964,938

[22] Filed: Nov. 30, 1978

[30] Foreign Application Priority Data

Feb. 12, 1977 [DE] Fed. Rep. of Germany ..... 2753858

[51] Int. Cl.[3] ..... D04H 1/20

[52] U.S. Cl. ..... 264/112; 264/121; 264/228; 264/333

[58] Field of Search ..... 264/112, 228, 333, 121

[56] References Cited

U.S. PATENT DOCUMENTS

| | | | |
|---|---|---|---|
| 3,489,626 | 1/1970 | Rubenstein | 264/228 |
| 3,637,457 | 1/1972 | Gothard et al. | 264/228 |

*Primary Examiner*—Donald J. Arnold
*Assistant Examiner*—James R. Hall
*Attorney, Agent, or Firm*—Michael J. Striker

[57] ABSTRACT

A method of manufacturing reinforced elements includes the steps of providing a lattice-like mesh of threads lying in a first plane, applying a plurality of reinforcing fibers so that they extend in planes located at angles to the first plane in which the mesh of threads lies, and embedding the lattice-like mesh with the thus-applied fibers into a bulk of cement. A reinforced concrete element includes a bulk of cement and a reinforcing structure comprising a lattice-like mesh of threads and a plurality of fibers located in planes which are inclined to the plane of the mesh. The reinforcing fibers may extend normal or be inclined to the plane of the mesh of threads. They may be prefixed to the same before the embedding step.

11 Claims, 2 Drawing Figures

METHOD OF PRODUCING FIBRE-REINFORCED CONCRETE AND SHAPED PARTS PRODUCED BY THIS METHOD

BACKGROUND OF THE INVENTION

The invention concerns a method of producing fibre-reinforced concrete in which a lattice-like mesh of threads is made, and it concerns shaped parts manufactured by this method.

The term "shaped parts" here includes construction slabs.

From German Patent Specification No. 41 435 a method of the category mentioned above is known in which strands or rods of glass fibres—preferably pre-stressed—are embedded in concrete. The purpose of the fibreglass rods here is to take the place of the usual metal reinforcement. By soaking the fibreglass rods with suitable resins they are protected against chemical attack, and at the same time they are made stable with respect to shape. In order to enhance the adhesion between the concrete and the reinforcement rod quartz sand is sprinkled over the soaked rods, or resin-soaked fibreglass strands are wound helically around the rods. In this method, where the fibreglass bars merely take over the function of a steel reinforcement and where the grains of quartz sprinkled onto the fibreglass rods merely produce the bond between the concrete and the fibreglass rod, no multi-directional, elastic reinforcing lattice is produced.

From German Patent Specification No. 39 245 a reinforcing unit for concrete, made from fibreglass-reinforced plastics, is known, where a granular material of quartz flour and fine stone chips is applied to the reinforcing unit, or the unit has profiled strips wound helically around it, in order to enhance the adhesion between the unit and the concrete. Again, no flexible, multi-directional, reinforcing lattice is obtained with the application of reinforcing units treated in this way.

From the documentation of German Design Patent (Gebrauchsmuster) No. 70 18 657, metal reinforceing rods, preferably for plastic parts, are known which possess bends whereby the reinforcing rods are anchored in the plastic.

In other known methods asbestos is used as a reinforcing fibre. In this case cement is used as a hydraulic bonding agent in order to process the relatively fine fibres which are often only a few millimeters in length. The method is reminiscent of the manufacture of cardboards. Fine asbestos-cement fleeces running one over the other are formed on a drum until the desired thickness is reached. They can then be taken off and compacted under pressure.

This method is effective even with the addition of very large amounts of water to the asbestos-cement mix. The bonding power of the cement remains intact owing to the close hydraulic union with the mineral fibres.

However glass or synthetic fibres cannot be processed by this method. The bonding force of the cement is lost.

The use of asbestos fibres leads to a number of annoying disadvantages. Their poor breaking elasticity restricts the applicability of the products, and the asbestos dust produced when the slabs are cut is extremely carcinogenic.

Methods of working alkali-resistant glass fibres into concrete are also known. In these methods glass fibres are first added in the concrete mixer. This leads to mixing problems (hedge-hogging and coagulation) and also injuries to the fibreglass surfaces which greatly impair the durability of the product.

Another method is based on the use of a concrete-spraying nozzle which brings semi-liquid cement mortar together with small quantities of chopped glass fibres. These fibres drop onto a support and while some are already bonded with the cement as they drop, others are only embedded in the paste on the support. This does indeed result in a multidirectional reinforcement, but the method is very labour-intensive and depends on the reliability of the workmanship. For example, if a number of fibre fragments drop on top of each other the bulk cement cannot penetrate the intervening spaces. Weak points in the reinforcement arise which will result in fracture when the finished parts are subjected to loading.

SUMMARY OF THE INVENTION

The aim of the invention is to create a reliable method of working fibres of any kind into batches of concrete. It must be suitable for reinforcing slabs, shaped parts and other articles producible from bulk cement in such a way as to guarantee a faster production flow and a uniform high strength.

This problem is solved according to the invention by disposing reinforcing fibres transversely or obliquely relative to the plan face of the mesh of threads and by working this mesh, furnished with the reinforcing fibres, directly into the bulk cement.

According to the invention, therefore, first a mesh, fabric or net of threads is produced in which more or less parallel threads are present at a determinable distance from each other. This distance is variable within wide limits. It may be a few millimeters or may be of the order of, e.g., 10 cm. Along this framework of filaments, according to the invention, fibres or fragments of fabric are disposed. The mesh of threads can be constructed from endless fibre filaments or from staple fibre yarns. The fibres may be of the same materials or may be entirely different kinds of fibres, when special properties of quantities of chopped glass fibres. These fibres drop onto a support and while some are already bonded with the cement as they drop, others are only embedded in the paste on the support. This does indeed result in a multidirectional reinforcement, but the method is very labour-intensive and depends on the reliability of the workmanship. For example, if a number of fibre fragments drop on top of each other the bulk cement cannot penetrate the intervening spaces. Weak points in the reinforcement arise which will result in fracture when the finished parts are subjected to loading.

The aim of the invention is to create a reliable method of working fibres of any kind into batches of concrete. It must be suitable for reinforcing slabs, shaped parts and other articles producible from bulk cement in such a way as to guarantee a faster production flow and a uniform high strength.

This problem is solved according to the invention by disposing reinforcing fibres transversely or obliquely relative to the plan face of the mesh of threads and by working this mesh, furnished with the reinforcing fibres, directly into the bulk cement.

According to the invention, therefore, first a mesh, fabric or net of threads is produced in which more or less parallel threads are present at a determinable distance from each other. This distance is variable within wide limits. It may be a few millimeters or may be of the order of, e.g., 10 cm. Along this framework of filaments, according to the invention, fibres or fragments of fabric are disposed. The mesh of threads can be constructed from endless fibre filaments or from staple fibre yarns. The fibres may be of the same materials or may be entirely different kinds of fibres, when special properties of the concrete are to be obtained. Their length is also variable. It may be a few millimeters to many centimeters.

The method is so constituted that the fibres applied experience a multidirectional disposition, and do so in the plane of the mesh of threads and/or extend beyond this plane. A three-dimensional reinforcement can also be achieved, if required. In this case the product from continuous filaments and cut fibres remains so open on its surface that it can easily be engulfed by the pasty bulk cement e.g. in an automated production step.

In order to ensure that the fibers are so firmly retained on the mesh of threads that they project from mesh, it is to be understood that several parameters must be determined in dependence upon one another. For example, the lateral distance between the threads of the mesh of threads, the elsticity of the fibers, and the length of the fibers can be varied.

According to an advantageous embodiment of the invention uncontrolled accumulations of fibres on the mesh of threads can be avoided by first furnishing the mesh with an adhesive and then exposing it to a stream of descending fibres, which then adhere to the mesh of threads with varying, random directions. Non-adhereing fibres drop off. Accumulations of fibres which are difficult for the bulk cement to penetrate are avoided.

According to another embodiment of the method a supporting stream of air can be used.

Another variant of the method provides for the disposition of rollers to roughen the pieces of fibre lying on the lattice, thereby elevating these fibres or fibre parts from the plane of said flat structure, and then strengthening them with a fixing agent. This can be done in a simple manner with a concrete adjusted to a thinly liquid consistency, or with the aid of commercial adhesives, e.g. ones having a plastic base. This stiffening can be accomplished by spraying or by a dipping process or by application with a doctor blade. This method is applied particularly when it is desirable to avoid compressing the voluminous reinforcing framework in the next production process.

The method of production of the reinforcing framework is not restricted to a particular type of fibre. Glass filaments can be used, the high strength of which is not altered by the influences of the cement. Synthetic yarns, say of polypropylene, which mainly improve the cracking resistance of the concrete, can also be considered. A combination of structural steel lattices or wire meshes with fibres or fabric fragments or strips of fabric is also possible, or the use of natural fibres like sisal, for example. Even fibres which cannot withstand the aggressive agents of the cement can be considered for the lattice framework, provided the added fibres possess this resistance.

The cut fibres or yarns intended to supplement the properties of the reinforcing framework can also be of the mentioned fibreglass kind, or of polyamides or other synthetic fibres, or steel fibres or wire. It is not intended, e.g., that a mesh of fibreglass threads can only be furnished with cut glass fibres, or a filament system of synthetic fibres only with fibre fragments of the same kind. With this method of production it becomes possible for the first time to work accurately predetermined mixtures of these fibres with each other into concrete and thereby attain new properties of the products.

Another advantage compared with the known methods of reinforcement with fibres results from the fact that separate zones of a structural part or slab which are subject to special stress can be strengthened. Fibreglass-reinforced slabs can be produced in such a way that very high breaking strength is attained that permits e.g. nailing. The boundary zones of a slab that is to be nailed on can be additionally reinforced by this method. The same applies to shaped parts which cannot be easily produced by the flexible reinforcing framework method and which can be suitably reinforced in the zones in which they are exposed to special tensile or impact stresses.

As another example of application we may mention sandwich slabs with a hard foam core. If a thin coating of cement mortar in which the described reinforcing framework is embedded is applied, e.g., over polystyrene plates, a stable slab that will support heavy loads is obtained which adds the strength of the slab surface achieved by reinforcement to the good thermal insulating properties of the polystyrene, without sacrificing easy workability by wood-processing machines.

A slab produced by the method of the invention is preferably made of cement. However, other binders, e.g. gypsum, may be considered.

A construction slab with excellent heat-insulating properties as well as very high mechanical strength is obtained if the construction slab, according to a particularly advantageous embodiment of the invention, contains an inner layer of polyurethane foam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

The mesh of threads according to the invention comprises longitudinal or warp threads 1 and transverse or woof threads 2. This mesh has been soaked with adhesive and is then exposed to a stream of fibre particles or fragments. Fibre particles 3 adhere with varying direction to the threads of the mesh, and together therewith constitute a three-dimensional, multidirectional reinforcing framework. This is then worked into a batch of cement according to any of the methods already described.

Figure 1:
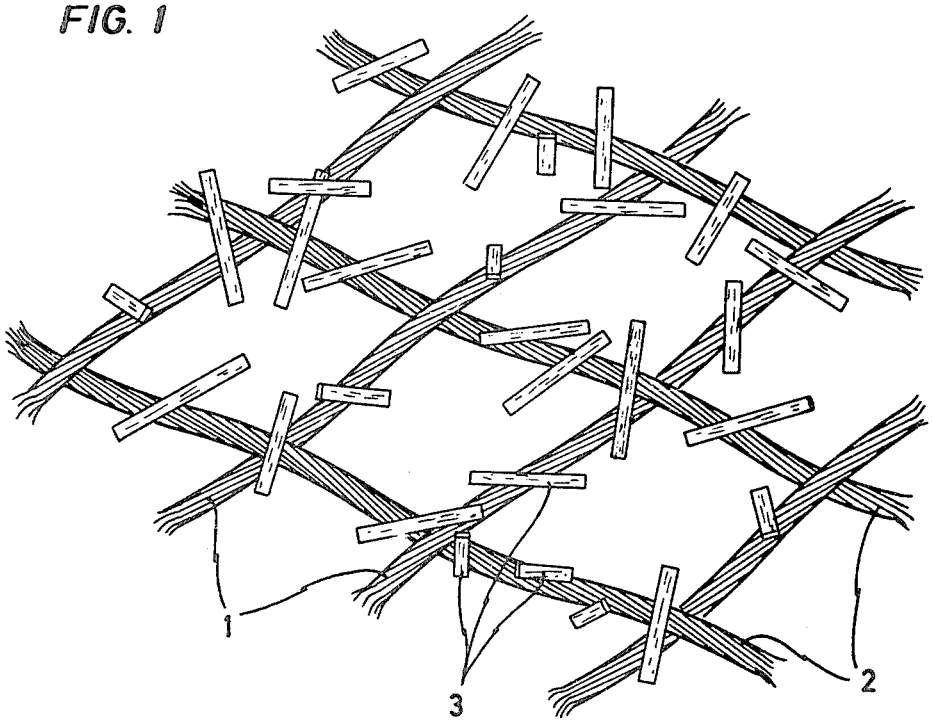
FIG. 1 shows a reinforcing framework according to the invention, viewed in perspective.
Figure 2:
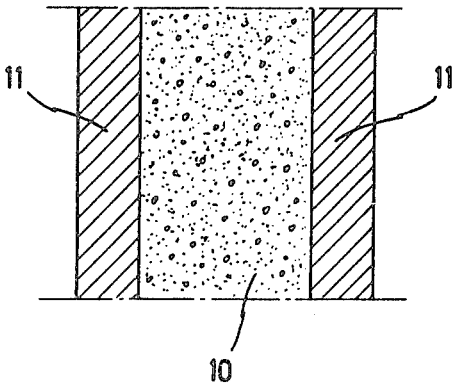
FIG. 2 shows a construction slab with an inner layer of polyurethane foam.

FIG. 2 shows a cross section of a construction slab produced according to the invented method. This comprises an inner support layer 10 of polyurethane foam, on either side of which cement slabs 11, reinforced according to the invention, are applied. For the production of this slab the polyurethane layer preferably has applied to it a reinforcing framework comprising a mesh of threads and the particles of fibre secured thereto. Then, on the covered side of the polyurethane foam layer liquid cement is sprayed with a nozzle up to a layer thickness of a few millimeters. The thickness of the polyurethane foam layer 10 is of the order of magnitude of one centimeter.

It will be understood that each of the elements described above, or two or more together, may also find a useful application in other types of constructions differing from the types described above.

While the invention has been illustrated and described as embodied in a method of manufacturing a reinforced concrete and an element manufactured by the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of manufacturing a reinforced concrete, comprising the steps of producing a concrete recipe by combining cement, sand, aggregate and water; providing a mesh of fibers extending in a plane; bonding to said mesh a plurality of reinforcing fibers; embedding said mesh with bonded reinforcing fibers intact into said concrete recipe; and hardening said concrete recipe with said mesh and bonded reinforcing fibers therein.

2. A method as defined in claim 1, wherein said reinforcing fibers extend substantially normal to said plane of said mesh of fibers.

3. The method as defined in claim 1, wherein said reinforcing fibers are inclined relative to said plane of said mesh of fibers.

4. A method as defined in claim 1, wherein said bonding step includes applying to said mesh of fiber an adhesive and supplying a stream of the reinforcing fibers onto the thus-processed mesh of fibers.

5. A method as defined in claim 4, wherein said supplying step includes supplying said reinforcing fibers with the aid of a stream of air.

6. A method as defined in claim 1, wherein said bonding step includes roughening said reinforcing fibers by bringing rotating rollers into contact with said reinforcing fibers prior to said embedding step so as to elevate said reinforcing fibers from said plane of said mesh.

7. A method as defined in claim 1, wherein said fibers and said reinforcing fibers are composed of a material selected from the group consisting of glass, polypropylene or sisal.

8. A method as defined in claim 1, wherein said providing step includes providing such a mesh of fibers in which the fibers are constituted by a material selected from the group consisting of a woven material and a knitted material.

9. A method as defined in claim 1, wherein said bonding step includes bonding such fibers which are constituted by a material selected from the group consisting of a woven material and a knitted material.

10. A method as defined in claim 1, and further comprising the step of embedding said mesh of fibers together with said reinforcing fibers applied thereto, into a hardenable cement paste, composed of cement and water, then removing said mesh together with said reinforcing fibers from said cement paste prior to, and followed by, said first-mentioned embedding step.

11. A method as defined in claim 1; and further comprising the step of prefixing said reinforcing fibers to said mesh of fibers prior to said embedding step, and including spraying said mesh together with said reinforcing fibers applied thereto, with said cement recipe, prior to said embedding step.

* * * * *